US005589245A

United States Patent [19]

Roell

[11] Patent Number: 5,589,245

[45] Date of Patent: Dec. 31, 1996

[54] TEXTILE SPACER MATERIAL, OF VARIABLE THICKNESS, PRODUCTION PROCESS AND USES FOR IT

[75] Inventor: Friedrich Roell, Biberach, Germany

[73] Assignee: TECNIT-Technische Textilien und Systeme GmbH, Laupheim, Germany

[21] Appl. No.: 200,185

[22] Filed: Feb. 22, 1994

[30] Foreign Application Priority Data

Feb. 22, 1993 [CH] Switzerland ..... 00540/93

[51] Int. Cl.[6] ..... B32B 3/26; B32B 5/26

[52] U.S. Cl. ..... 428/85; 55/DIG. 43; 428/87; 428/96; 428/233; 428/240; 428/246; 428/251; 428/253; 428/254; 428/311.1; 428/920

[58] Field of Search ..... 428/253, 254, 428/244, 240, 246, 251, 311.1, 87, 96, 85, 920, 333; 55/DIG. 43

[56] References Cited

U.S. PATENT DOCUMENTS 4,019,350 4/1977 Schmidt .
5,166,480 11/1992 Bottger et al. ..... 181/292
5,284,031 2/1994 Stoll ..... 66/64
5,334,442 8/1994 Okamoto ..... 428/246
5,395,684 3/1995 Robinson et al. ..... 428/253
5,413,837 5/1995 Rock et al. ..... 428/192
5,422,153 6/1995 Miyamoto ..... 428/95

*Primary Examiner*—James C. Cannon
*Attorney, Agent, or Firm*—Smith-Hill and Bedell

[57] ABSTRACT

The textile spacer material is a material for replacing foamed substances; it consists of two knitted or woven covering layers that are connected by a pile thread structure. The pile thread structure produces the compressibility known from flexible foams and the large air fraction. The elasticity can be determined by the length and density of the pile threads and the material used. When recyclable materials are used, an environmentally compatible foam substitute can be obtained. Moreover, the textile spacer material can also assume chemical or physical properties through the use of treated starting material or a treatment during or after production and thus be used as a filter or catalyst material, for example.

12 Claims, 2 Drawing Sheets

TEXTILE SPACER MATERIAL, OF VARIABLE THICKNESS, PRODUCTION PROCESS AND USES FOR IT

The present invention relates to textile spacer material, its production and use, particularly as a substitute for plastic materials with foamed components or for multilayer textiles.

Plastic material with foamed components is of great importance in technology. For one thing it offers good insulation capability because of its large air fraction. If an elastic plastic is foamed, the product can be used, for example, for upholstery, for seats, chair backs, etc., or also for vehicle roof liners, which in the event of an accident must protect the occupants from the worst consequences of impact with the roof structure. Foamed materials can also be absorbent and can then also be used, among other things, in the medical sector as bandaging materials or in the incontinence area.

However, disposal of foamed materials has recently become problematic. Particularly in projects that are oriented towards the complete recyclability of the materials used, it is often foamed plastics that are a great obstacle.

Another known problem lies in the fact that foamed materials often had to be surface-clad for stabilization purposes or for aesthetic reasons. For this purpose it was necessary to produce the surface material separately and bond it to the foam or introduce the latter into an envelope made of the surface material.

Similarly, the production of textile products of greater thickness by subsequently bonding several layers of woven or knitted fabric was also known. However, subsequent bonding makes this technology complicated and expensive and is not applicable in certain applications where exact, structure-parallel alignment is required.

One problem of the present invention is to make available a material that can be used in place of foamed materials.

Such a material is described in claims 1 and 2. Additional preferred embodiments and uses are described in the other claims. Accordingly, the so-called textile spacer material consists of at least two covering layers, which are joined by a pile thread structure.

Figure 1:
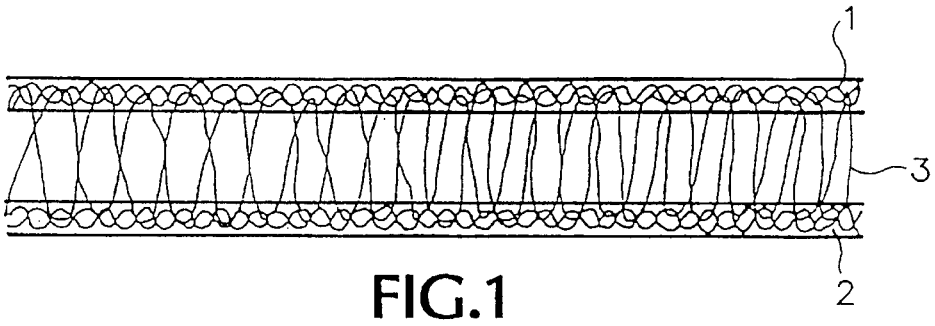

FIG. 1 shows the basic structure of a textile spacer material according to the invention in cross section, and FIG. 2 to 9 show the pile thread bonds of some embodiments.

The textile spacer material consists basically of two covering layers 1 and 2, preferably of knitted fabric, which are connected by the pile thread structure 3. Such textile spacer materials and their production on looms are known, for example for the production of carpeting for which the pile thread structure is cut through and then forms the upper side of the carpet. Therefore the production process will not be discussed further in detail. What is surprising is the finding that the textile spacer material can replace foams without problem and is even superior to the latter in adjustability of properties, as will be explained below. Compared with the known multilayer textile materials, the material according to the invention first of all has the advantage that due to the integral production process, in which the additional expensive bonding step is no longer necessary, the individual layers can be configured with a structural offset that is accurately predictable, namely exactly parallel. Moreover, the pile thread structure also makes greater thicknesses possible, without or with only slightly higher consumption of materials.

The principle involved in producing textile spacer materials on knitting machines, such as are described, for example, in *Kettenwirbraxis* 4 (1970), pp. 19–20, but also on double hook looms is known. In contrast, the previously unknown process of producing textile spacer materials on knitting machines in accordance with the invention allows, to a significantly greater extent, the formation of two-dimensional, two-and-a-half- or three-dimensional structures, such as regular or irregular open work, holes, slits, straps, tufts, shapes, etc. This naturally does not exclude subsequent mechanical shaping, especially in connection with a material-stiffening finish that makes it thermally deformable, for example. It is also possible to insert additional interlayers, which are bonded to one another and with the covering layers by pile thread structures.

FIGS. 2 to 6 show several preferred embodiments of the invention in diagrams that show the course of the pile thread with respect to the needles, which are used to produce the covering layers 1, 2 wholly or partially in the form of knitted fabric, and/or the warp threads 4 in the covering layers 1, 2. For reasons of a better overview the covering layers themselves are not shown. For simplicity's sake the explanation below is given using knitting terms in accordance with the preferred embodiment, which does not limit the invention, however. In the case of woven covering layers or those containing woven components the corresponding equivalents from weaving technology shall be used analogously, such as warp thread in place of needle or rod, pick in place of row, etc.

Figure 2:
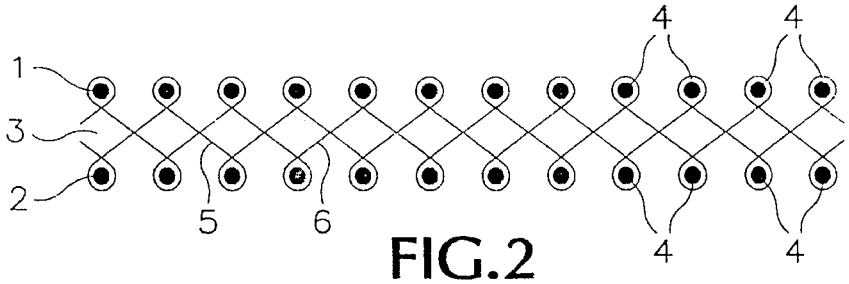

The pile thread structure in FIG. 2 is only carried over every second needle (or warp thread) 4. For bonding purposes a second pile thread 6 is carried so that it is staggered with respect to the first. Also possible is a staggered laying of the pile thread in different rows, whereby any other divisions/are also possible, which can even change. The following examples are cited: pile thread on every third needle; pile thread on every fourth needle; sequence of needles used according to rows 1-3-2-4- . . . .

It is also possible to carry the pile thread over two or more adjacent needles and only then to knit it into the other covering layer or to carry or hang the pile thread or threads over or on arbitrarily selected needles. Especially with a stiffer pile thread material, the result is a curved course of pile thread similar to a wavy line. If two complementary pile thread courses are used, then tubular formations result in the pile thread structure, as are already indicated in FIG. 2. Especially when the thread is carried over two or more adjacent needles, looping can be dispensed with, and instead the pile thread is only placed over the needles or knitted into the respective covering layer with a weaving bond. Such an embodiment is shown in detail in FIG. 8 and 9. The pile thread 5 is carried around three needles (or warp threads) of the one covering layer 1 and thus bonded to it. The pile thread 5 is then carried freely over six needles to the other covering layer 6 and then knitted into it again via three needles. Overall then the pile thread 5 is knitted into a covering layer vial several, in this case three, needles, is then carried to the other covering layer over a certain number of needles, preferably a larger number than before, knitted in there, etc. The knitting-in width and the length of the pile thread for the switch from one to the other covering layer can be adapted to the particular purpose within broad limits.

Figure 8:
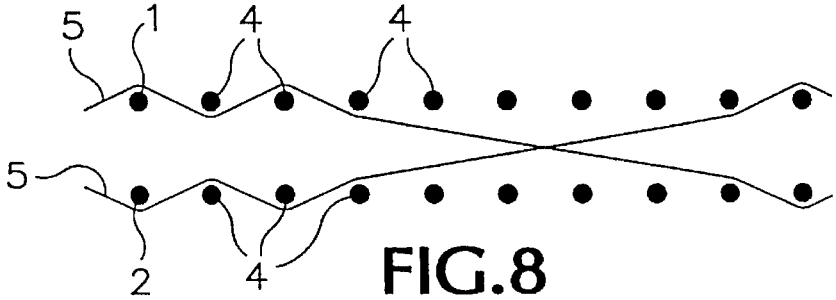
Figure 9:
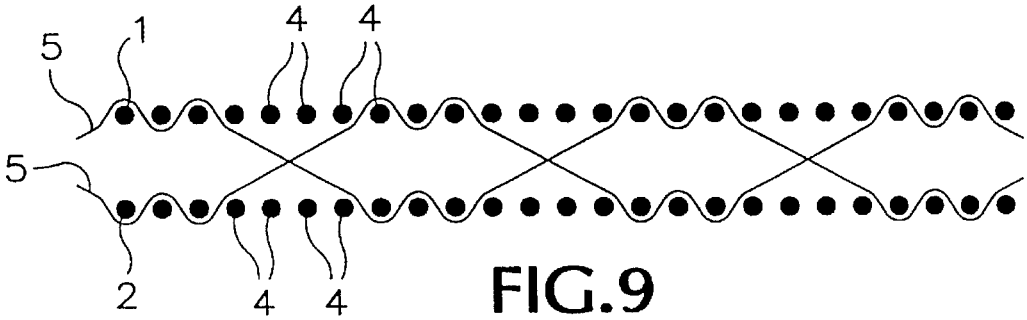

An interesting embodiment is the use of different materials for covering layer and pile thread. If the pile thread is produced from a relatively stiff material, such as a monofilament, and the covering layers from a material that is shortened at higher temperatures, then a contraction of the covering layers can be achieved by heating, whereby the pile thread material remains essentially unchanged. The pile thread is then also contracted to a shorter distance, as shown in FIG. 8 and 9 before and after heat treatment, respectively. The use of a stiff monofilament counteracts wrinkling, so that the pile thread essentially retains its stretched course and thereby presses the covering layers apart and forms tubular structures in the inside, given a parallel course of the pile threads (FIG. 9). On the whole such a textile can also be converted by heating from a relatively compact form to an inflated form having a large air fraction, possibly also with tubular structures.

Another possibility consists in producing only one covering layer from a thermally contractible material. With heating the result is the effect described above, but, since only one side of the textile contracts, there is at the same time also a curvature or arching, depending on whether the entire material or possibly only the warp and weft threads consist of the material that can be affected thermally. Instead of a thermally sensitive material, materials that react to other chemical and/or physical influences with a change in length can also be used.

Figure 3:
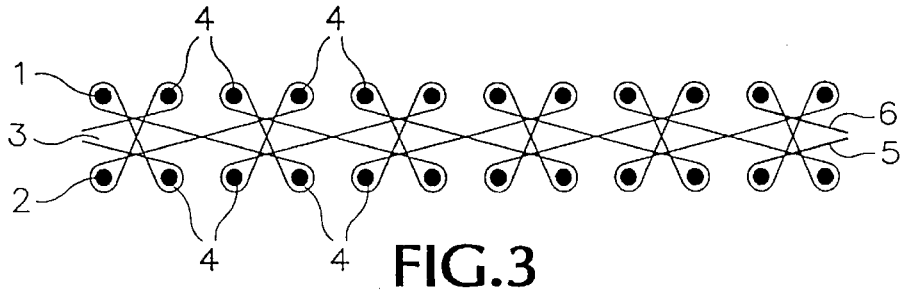

FIG. 3 shows pile threads routed in a sawtooth shape, which produce an especially voluminous filling volume. To prevent the two covering layers from slipping, the pile threads are advantageously placed opposite one another in a certain rhythm.

Figure 4:
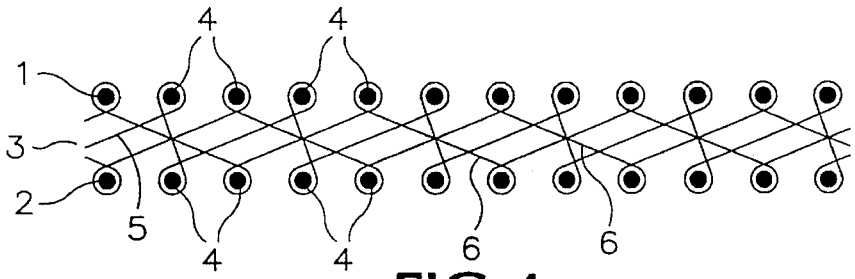

FIG. 4 also shows a sawtooth-shaped laying of the pile thread 5, specifically in alternation with two other courses of pile thread 6 that are laid down by the other needles 4, in the same or in subsequent rows, as desired.

Figure 5:
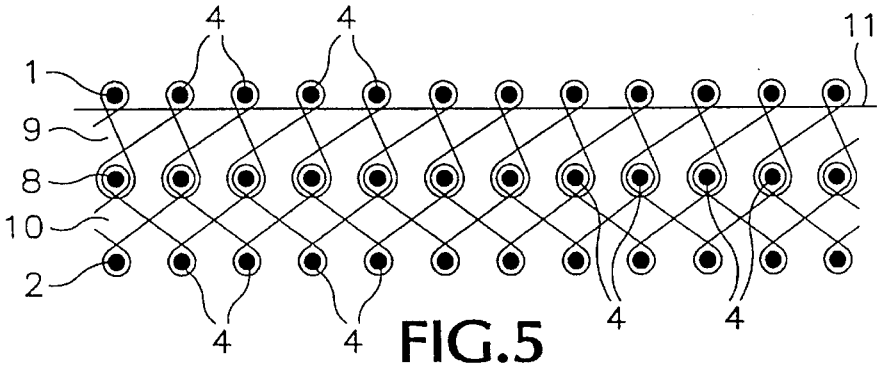

FIG. 5 shows a structure that has a middle layer 8 held by two pile thread structures 9, 10. The structure can have different behavior on the two sides due to the two different pile structures 9, 10. It is also possible to shear off the material, for example below the upper needle row 1, more or less along the shearing line 11, after which a plush surface results on this side. The surface can be further adapted to the particular application by means of additional treatment such as roughening.

Figure 6:
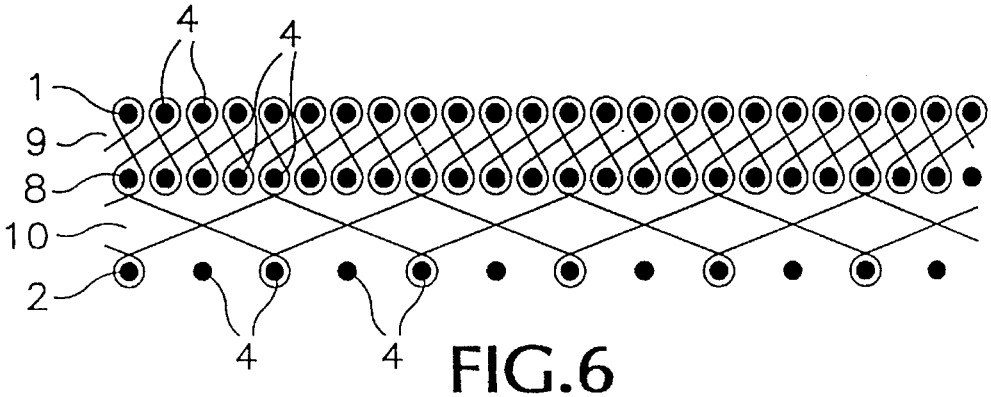
Figure 7:
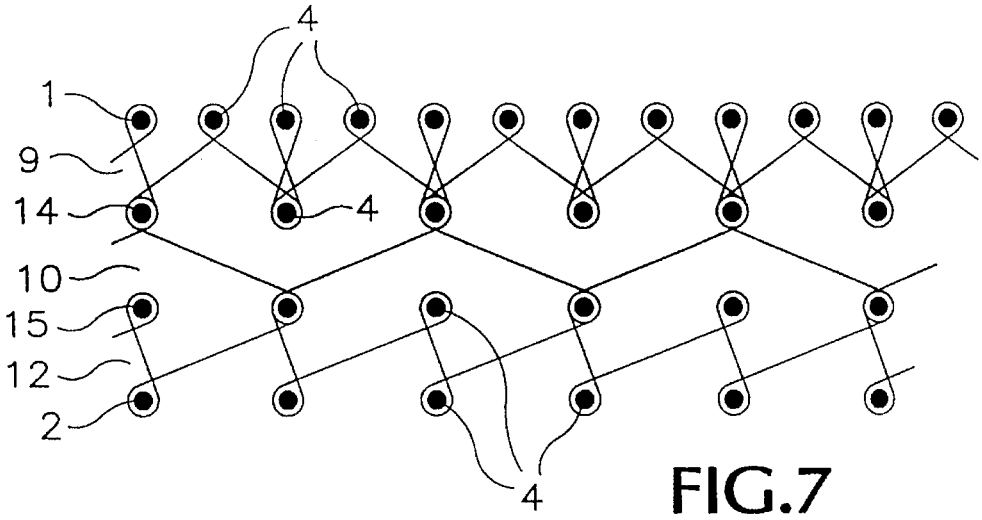

FIG. 6 shows an embodiment with pile thread structures of different heights, a thinner one 9 and a thicker one 10, which are also executed with different needle spacing. The thinner pile thread structure 9 is executed over a tighter needle spacing 1, 8, whereby the pile thread 5 is looped around all needles. Thus this structure is relatively strong and dense in spite of its small thickness. The second pile thread structure 10 connects the narrower spacing of the middle layer 8 to the wider spacing of the lower covering layer 2. In this case every second needle of the lower covering layer 2 is occupied by the pile thread and every fourth one in the needle row of the middle layer 8 in an assumed spacing ratio of 1:2. FIG. 7 shows a further expansion, in which a wider pile thread structure 12 is present so that two covered middle layers 14, 15 are present. Moreover, in this case only the needle row 7 of the upper covering layer is set up with narrower spacing, and the needle rows of the other covering layers 14, 15 and 2 have identical spacing.

The examples cited show the variety of resulting embodiments and can be combined with one another within the framework of the invention. The covering and middle layers that are not shown can be knitted fabric, woven fabric or mixed forms of the two, in all known variations. In the case of woven layers a looping of the warp threads typical for knitted goods can also be executed using modern machinery for the purpose of knitting in the pile threads, or the pile threads are knitted in with one of the known weaving bonds.

Suitable starting materials are all thread materials known today that can be processed on the machines cited, such as monofilaments, multifilaments, and multicomponent filaments. Natural and synthetic fibers are suitable base material, but also wires, for example, or mineral material such as glass or rock fibers. The thread material can also be covered, sheathed, wrapped and/or surface-coated. Warp threads, especially in the case of natural fibers, are preferably sized before processing, and the textile spacer material then desized.

The pile thread structure contributes the features characteristic of foamed materials, among which the most important are the following: large air fraction, elastic behavior, absorbency. One of the properties can also be emphasized depending on the material used for the pile thread structure or the subsequent treatment. By using natural fibers, in particular, it is also possible to achieve a textile material of high absorbency that is pleasant to the skin, whereby it can be used in the incontinence area or as a bed liner to prevent bedsores in hospitals. The pile thread material can also be changed subsequently by chemical or physical methods, either reversibly or irreversibly. The use of a temperature-sensitive material in the pile thread structure that changes its length with a temperature increase, for example, is cited as an example. This produces a spacer material whose thickness is a function of temperature, whereby an insulating effect can be automatically adjusted to temperature, for example. The material also cannot react reversibly, or if so, only partially.

An important advantage of the textile spacer material lies in the fact that a large number of adaptations for the intended use can be carried out simultaneously with production. The simplest possibility consists in the selection of the thread material or other classic process parameters of production. The mechanical and physiological properties can thus be varied at that time within broad limits. For example, a stiffer thread material for the pile thread structure increases the shock-absorbing capability, and vice versa. An alternative is also to increase or reduce the pile thread density, i.e., the number of threads per $m^2$. One application results generally in a filling, upholstery or insulating material, for example in the automotive or apparel industries. Since the length of the pile threads and thus the thickness of the textile spacer material can also be varied without problem during production, it is possible to produce cushions that fit or adjust to the shape of the body.

During production a filler material, in particular a solid one available in a granular or powder form, for example, can be introduced into the pile thread structure, which results in a uniform filler distribution, even in large lengths produced in one piece. It is also conceivable to activate the filler in an appropriate way by heat, radiation, etc., after production of the textile spacer material, either to convert the filler to another form that satisfies a specific function or to use it to change the properties of the pile thread structure of the covering layers from within. The textile spacer material can also be subsequently coated and/or the pile threads can be surface-modified. Other possibilities for influencing the material are accessible to the expert from the statements made above and are included by the inventive idea.

The textile spacer material can also be used as a filter material, whereby special properties can also be formed by appropriately pre-treating the thread material for the pile thread structure and/or post-treating the textile spacer material. For example, activated charcoal can be injected into the pile thread structure or also introduced into the pile thread structure during production. The insertion of a catalyst by one of the methods cited is also possible. Applications result in the area of air, gas and dust filters, for example, and in chemical process engineering.

Another possibility consists in impregnating the pile thread structure or even the entire textile spacer material, whereby, depending on the type and quantity of the impregnating material, either a sheathing of the threads or a filling of the cavities is more likely to result. With this method it is possible to produce all materials ranging from a large-volume material with a high air fraction and coated threads to a completely filled body, similar to a bonded fiber product, for example. The use of a hardening impregnating agent such as a resin, synthetic resin, thermoplastic, etc., permits the production of a textile material that is stiffened in accordance with hardening and has an air fraction that can be adjusted by means of the other production parameters. With the textile spacer material the thickness and the material can be adjusted within broad limits in accordance with the requirement profile, but in a well-defined way.

Partial impregnation can be used for modification of behavior with respect to the medium that passes through the pile thread structures, especially liquids or gases, for example in filters, in order to separate out specific substances or for catalytic effect, or the mechanical properties of the textile spacer material can be changed. A textile spacer material stabilized in this way that still has a rather loose pile thread structure can be used for rear ventilation purposes, for example, or in applications with more stringent mechanical requirements, particularly with respect to tear resistance and shock absorption. A multiple treatment is also conceivable. Furthermore, such a treatment, in addition to selection of the appropriate material, can render the textile spacer material resistant to environmental effects such as heat (fire) or aggressive chemical substances, and because of its insulating effect and absorbency it can then be used in protective clothing and other industrial cladding or linings, such as machine covers.

A three-dimensional shape is possible to a limited degree by varying the pile thread length, pile thread density and or the pile thread material. Extensive freedom in shaping is provided on knitting and hosiery-knitting machines by the known shaping techniques, such as increasing and decreasing stitches. Obviously shaping does not require any additional process step. It is also possible to produce a preboarding form tailored to the eventual shape. It can later be shaped mechanically in the desired shape and set. Controlled shaping is also possible through the selection of suitable, basically known thread materials that react to chemical or physical effects such as temperature or acidity. For shape setting it is possible, if the inherent stability of the material is not sufficient, to use either impregnation with a hardening material or one of the other common techniques such as heat setting.

Since the covering layers are a woven or knitted fabric, the techniques known in those product areas for coloration, patterning and structuring can be used. With such techniques it is possible, for example, to produce aesthetically pleasing liners and cladding of the textile spacer material directly from the machine. Applications for interior liners for automobile roofs, upholstery and other liners and cladding result, for example. The textile spacer material can also be coated or laminated. The covering layers can be provided with plush, for example. Flocking, printing, etc., are likewise possible.

As a result of the selection of a suitable material for the covering layers and the bonding pile thread structure it is possible to adapt the textile spacer material to very different applications that have previously been the domain of foamed materials. Additional advantages result from the fact that a broader selection of starting materials is available for the thread material than for foamable material. Natural materials, in particular, are possible for recyclable textile spacer material. Applications result for all areas in which foamed materials or multilayer textiles are used, such as filters; sound insulation; foam substitutes, especially for laminates or backed fabrics; rear insulating materials; liners and cladding; clinical and medical applications such as incontinence products, bedsore prevention, bandaging materials; mattresses and blankets, electric blankets; shoe soles and inserts; upholstery; spacers; climatic zones: coverings and liners in the automotive sector, such as convertible tops, vehicle roof liners, seat covers; two-and-a-half-dimensional products, such as reusable baby pants.

One interesting application for the material is the lining of wheel housings. For this purpose it is shaped either three-dimensionally in accordance with the wheel housing shape or it is made in this shape in a controlled knitting process by increasing and decreasing stitches. By bonding, such as impregnation with a thermoplastic or also by the use of thermally hardenable pile thread material, it is set in this shape by heating. This heating process can occur advantageously after the material has been mounted in the wheel housing. Photochemical hardening would also be conceivable, among other things, for example by ultraviolet radiation. The material preferably has a rough surface and permits the penetration of injection water into the pile thread structure, in which it can then drain off again. In this way the eddying of the injection water is substantially reduced. The side turned away from the wheel is preferably made impermeable to water.

Other applications in comparison with known materials result naturally from the statements made above. One example would be the production of a shaped product with a large air fraction from a resin-impregnated textile spacer material.

I claim:

1. Textile spacer material having at least an upper and a lower knitted covering layer, which are connected by at least one pile thread, at least one of said covering layers comprising inlaid weft or warp yarns, wherein at least one of the inlaid yarns is introduced into said one covering layer in a direction transverse to the direction of the pile thread.

2. Textile spacer material according to claim 1, wherein said one covering layer comprises both inlaid weft yarns and inlaid warp yarns.

3. Textile spacer material according to claim 1, wherein the connection between the covering layers and the pile thread is at least partly realized by surrounding the inlaid yarns with the pile thread.

4. Textile spacer material according to claim 1, comprising at least one textile interlayer located between the covering layers, which textile interlayer is connected to the covering layers by means of pile threads.

5. Textile spacer material according to claim 1, comprising at least two textile interlayers located between the covering layers, which textile interlayers are connected together by means of pile threads.

6. Textile spacer material according to claim 5, wherein at least one of the textile interlayers is connected to the covering layers by means of pile threads.

7. Textile spacer material according to claim 1, wherein the pile thread is made of a material that reacts to chemical or physical effects.

8. Textile spacer material according to claim 1, wherein the courses of pile thread are executed so as to vary regularly.

9. Textile spacer material according to claim 1, wherein the upper and lower covering layers consist of different materials.

10. Textile spacer material according to claim 1, wherein the pile thread and the covering layers consist of at least two different materials.

11. Textile spacer material according to claim 1, comprising fillers, or chemical reagents, or substances having physical activity, deposited in the pile thread structure.

12. Textile spacer material having at least upper and lower knitted covering layers, which are connected by at least one pile thread, at least one of said covering layers comprising inlaid weft and warp yarns, wherein said warp yarns are introduced into said covering layer in a direction transverse to the direction of said pile thread.

* * * * *